United States Patent [19]

Nunciato et al.

[11] 4,203,778

[45] May 20, 1980

[54] METHOD FOR DECOKING FIRED HEATER TUBES

[75] Inventors: David J. Nunciato, Missouri City, Tex.; Norman H. White, Amherst, N.Y.; William A. Woodburn, Kingwood, Tex.

[73] Assignee: Union Carbide Corporation, New York, N.Y.

[21] Appl. No.: 906,748

[22] Filed: May 17, 1978

[51] Int. Cl.[2] ..... B08B 9/02

[52] U.S. Cl. ..... 134/7; 134/8; 134/30; 134/39

[58] Field of Search ..... 134/8, 22 C, 30, 39, 134/7; 201/2; 137/15; 51/317, 320, 321, 322, 323; 15/3.5

[56] References Cited

U.S. PATENT DOCUMENTS

| | | | |
|---|---|---|---|
| 1,939,112 | 12/1933 | Eulberg | 134/7 X |
| 2,285,157 | 6/1942 | Grayson | 134/7 UX |
| 3,073,687 | 1/1963 | McCune | 51/317 |
| 3,082,073 | 3/1963 | McAnneny | 51/317 |
| 3,745,110 | 7/1973 | Allred | 201/2 X |
| 4,048,757 | 9/1977 | Kubus et al. | 15/3.5 X |

*Primary Examiner*—Richard V. Fisher
*Attorney, Agent, or Firm*—Dominic J. Terminello

[57] ABSTRACT

Method of decoking furnace tubes of serpentine configuration using a turbulent stream of impact resistant, non-angular, non-abrasive particles entrained in a gas stream. The particles are entrained at a concentration of 0.1 to 1.0 pounds per pound of gas and the gas is introduced into the inlet end of the furnace tubes at a gas flow rate corresponding to an outlet gas velocity of 14,000 to 20,000 feet per minute.

5 Claims, 1 Drawing Figure

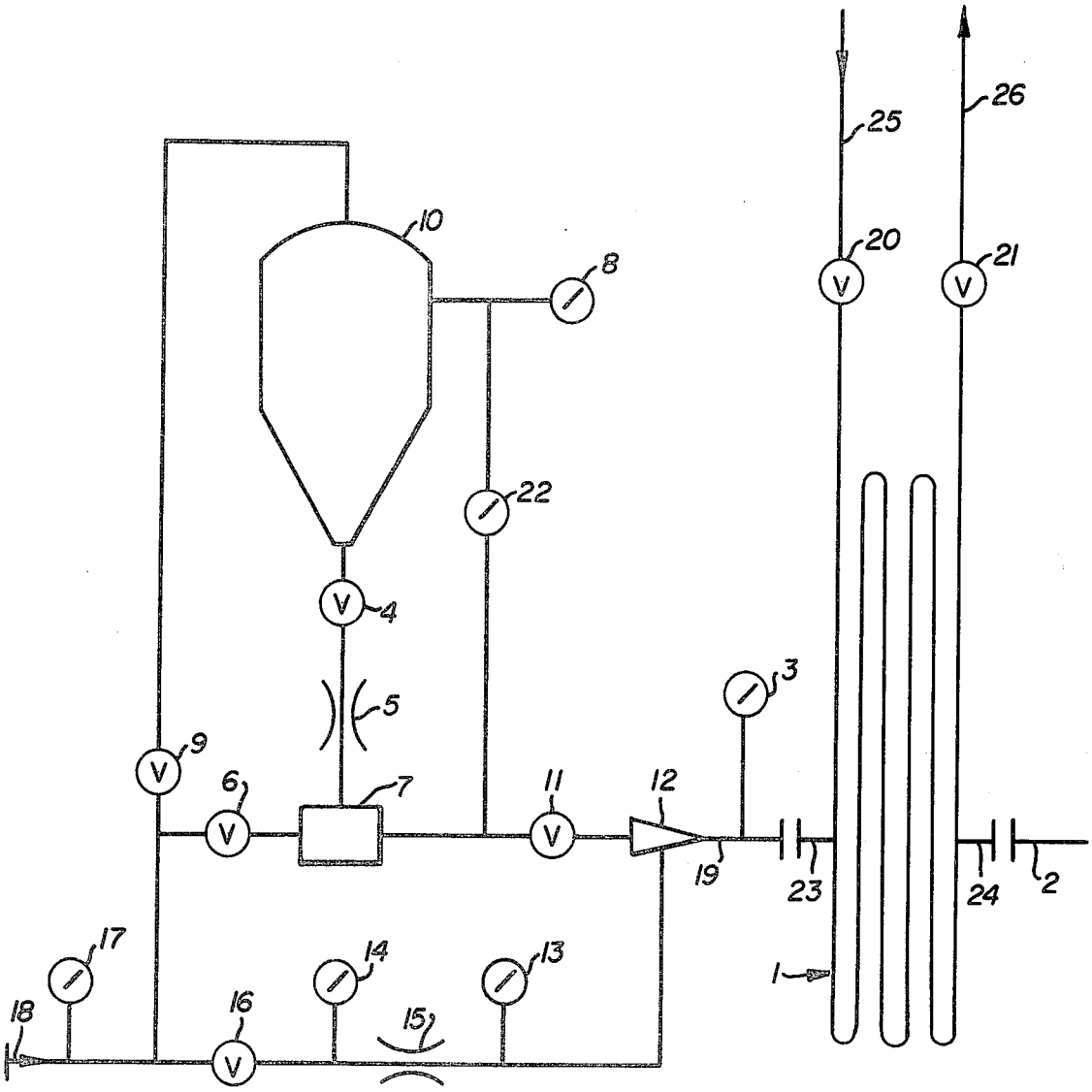
25
26
10
20
21
8
22
4
5
3
9
6
7
11
12
19
23
24
2
17
14
13
1
18
16
15

METHOD FOR DECOKING FIRED HEATER TUBES

This invention relates to a method for use in cleaning brittle materials from the inside surface of fired heater tubes and more particularly, to decoking the walls of fired heater tubes used in hydrocarbon processing.

BACKGROUND AND PRIOR ART

There are several thousand hydrocarbon furnaces located in world refineries and petrochemical plants. In general, these furnaces vary in size and style but each contains fired heating or reaction coils most often of a serpentine configuration commonly called furnace tubes, which transport the hydrocarbon charge stock being heated and processed. During normal operation a solid carbon material, commonly referred to as coke, is formed adjacent to the inner wall of the tubing. The formation, which is a result of continuous heating of the zero velocity fluid layer immediately adjacent to the fluid boundary, grows in thickness in a continuous manner with time. Eventually, removal of the coke deposits becomes necessary due to excessive pressure drop across the tubes, reduced throughput through the tubes, or reduction in thermal efficiency below some allowable minimum.

Several methods for internal cleaning or decoking of hydrocarbon furnace tubes are currently employed, the most common of which are mechanical cleaning (commonly known as turbining), hydroblasting, and steam-air decoking.

Turbining essentially consists of cutting or reaming the coke deposits from the tube wall by passing a cutting head through each straight section. This method requires that the furnace be disassembled to the extent that the inlet and outlet of each individual straight section of tube is exposed to allow entry of the cutting head. For those furnaces of welded return bend design this means that return bends must be initially cut off and welded back in place after cleaning. Commercial sandblasting is usually employed to clean the return bends. This method has several major drawbacks, including: (1) it results in substantial downtime; (2) it is labor intensive; (3) it results in substantial tube wall wear and subsequent premature tube failure as a result of improper alignment of cutting head and furnace tube; and (4) causes severe erosion of return bends.

The second technique, known as hydroblasting, is similar to turbining except that instead of the cutting tool a hydraulic device is inserted into each tube. The device produces high pressure water jets directed normal to the tube wall which dislodge the deposit by impact. Again, this method results in substantial downtime and is labor intensive for the same reasons mentioned above. Furthermore, the high pressure water tends to dissolve sulfur initially deposited on the tube wall and results in possible sulfuric acid corrosion of the tubes in addition to creating a significant waste disposal problem.

Both of the above processes require that the furnace be cooled to near atmospheric temperature. Not only does this result in significant additional downtime, but in certain furnaces the cool down process itself can result in destruction of the furnace tubes. It is not uncommon during cool down for a furnace tube to fracture longitudinally as a result of differential thermal contraction. The heavy inner layer of coke has a significantly lower thermal expansion coefficient compared to typical tubing material and can result in circumferential thermal stresses in the tube wall in excess of its ultimate tensile strength.

Probably the most common method of decoking furnace tubes is by injecting metered amounts of steam and air into the tubes with the furnace fired. The solid coke is thus removed by a highly exothermic reaction between the solid coke and air which generates a gas-solid stream of coke particulate, CO, $CO_2$, $SO_2$ and $NO_x$. The steam is used to cool the products of reaction. Process steps include: (1) removing the furnace from hydrocarbon service; (2) connecting decoking lines to the furnace; and (3) introducing steam and air to induce controlled burn out. Though furnace downtime is considerably less than the above two processes, this process can result in serious and costly furnace damage. During the process the tube skin temperature must be maintained within very narrow limits so as to both sustain the temperature required to support the reaction and yet limit the reaction temperature below the tube melting point. This highly exothermic reaction frequently results in ruptured tubes and fittings and hence costly downtime. In addition, the high temperature reaction of oxygen can leave an oxide layer on the inner tube wall which will inhibit heat transfer. Mechanical cleaning or polishing must be used to remove the deposits subsequent to steam air decoking operations. Finally, a further disadvantage of this process is that the effluent gases are highly toxic and thus create serious environmental problems, if not properly handled.

SUMMARY OF THE INVENTION

The method proposed herein consists essentially of injecting a commingled stream of high velocity gas, preferably nitrogen, and impact resistant particles, preferably non-angular steel shot, into the inlet of the tube set. By non-angular is meant a particle having no sharp corners. The gas stream has imparted thereto turbulent and swirl components. The turbulent and swirl components of the local fluid velocity induces a high radial particle velocity causing it to strike the coke layer with sufficient energy to dislodge chips of coke which are then transported out of the tube set by the gas stream. The process is continued until all coke has been removed, as evidenced by clean, coke-free effluent. Primary features of the process include: (1) the process can be performed in-place without disassembling the furnace; (2) there is no damage to furnace tubes or return bends; (3) the process does not require that the furnace be fully cooled down, in fact, in most instances it can be performed at full operating temperature; and (4) the process thoroughly cleans leaving no oxide film which reduces thermal efficiency or coke traces which serve as nuclei for accelerated reformation. The method of the invention includes preliminary clearing of the tube set to be cleaned by the use of gas drive, sometimes referred to as purging. Following this, a gas flow, in which impact resistant particles are suspended, is introduced into the inlet end of the tube set while the outlet end remains substantially open to the atmosphere. The gas flow is provided in adqeuate volumetric quantities so that high turbulent velocities are produced throughout the tube set. The supply of particles is maintained until the inlet pressure indicates a minimum selected velocity has been reached whereupon the particle supply is temporarily terminated and gas drive continued until all loose debris is discharged. The process is repeated until the tube set is clean as evidenced by clear, coke-free effluent.

DESCRIPTION OF DRAWING

The sole FIGURE in the drawing is a schematic illustration of a typical furnace connected to apparatus for practicing the invention.

DESCRIPTION OF THE APPARATUS

With reference to the drawing FIGURE, an isolated section of a typical furnace comprised of one or more serpentine tube sets connected in series is illustrated in schematic form with charge stock inlet 25 isolated from the tube set by valve 20 and charge stock outlet 26 isolated from the tube set by valve 21. Flanged or similar type connections 23 and 24 are provided for tie-in from the tube set to the cleaning system. Injection head 12, which serves to commingle the flow of gas and cleaning particles, is connected to the inlet of the tube set through line 19 by pipe flange or other suitable means. Particle feed rate is controlled by valve 9 and calibrated orifice 5; differential pressure gauge 22 provides an indication of the driving force across orifice 5 which can be controlled by throttling valve 9. Critical flow orifice 15, in conjunction with upstream orifice tap pressure gauge 14 and downstream orifice tape pressure gauge 13, provide a means of establishing and maintaining the proper propellant flow rate from source 18. Valve 6 allows bypass of a small volume, high speed flow of gas which serves to propel the shot into injection head 12 where it is commingled with the main flow stream and injected into the tube set. Valve 4 allows on-off control of particle supply from supply pot 10 to mixing chamber 7.

DESCRIPTION OF THE METHOD

In general, the method of the proposed invention includes the following procedural steps:

With reference to the drawing FIGURE, the tube set 1 is cleared preliminarily by purging to the atmosphere. Purge gas is initiated by opening valve 16 with valves 11, 9 and 6 closed to isolate the impact resistant particle supply system. Pressure gauge 17 is used to monitor the gas supply pressure to the system. After the tube set 1 has been purged for a suitable length of time, as evidenced by a clear effluent from discharge end 2 and stable pressure reading from pressure gauge 3, valve 4 is opened allowing a controlled flow of particles to flow through orifice 5. Simultaneously, or shortly thereafter, valve 6 is opened allowing gas to flow to mixing chamber 7 where it is commingled with the impact particles and serves to drive the particles into injection head 12 and eventually into tube set 1. Gas flow rates are selected so as to provide an outlet gas velocity between 14,000 and 20,000 feet per minute. Generally, a velocity greater than 20,000 feet per minute provides negligible process improvement whereas a velocity below 14,000 feet per minute can result in less than optimum cleaning effectiveness, especially at the tube inlet. In the injection head 12 the commingled stream achieves an angular velocity component required for cleaning. The pot pressure 8 is maintained higher than inlet tube set pressure 3 by throttling valve 9, thereby ensuring a regulated flow of particles to the tube set. The supply of particles is maintained until the inlet pressure 3 reaches a maximum value corresponding to a minimum inlet velocity required for entraining the particles and cleaning the inlet portion of the tube set 1, the pressure rise at the inlet being caused by back pressure in the tube set resulting from the increase in concentration of coke debris. For any given tube set, these values are preselected based on tube geometry, coke thickness, and particle size, etc. Accordingly, valve 4 is closed thereby directing the full flow of gas to the tube set. The purge is continued until the effluent again appears clear and the pressure 3 stable. At such time, the cycle is repeated. The length of time of each run and the total number of runs required depends on the physical characteristics of the coke and as such, will vary from furnace to furnace. In general, however, the interior of the line will clean to a coke-free finish. The progress of the operation may be determined roughly by examination of the effluent: during each successive run the effluent will become lighter in color from initially thick black to coke-free clear, indicating that all coke has been removed.

THEORY OF OPERATION

It was found in material tests of representative samples of coke deposits that the material exhibited extremely high hardness values of the order of steel using the Mohs hardness method. Based on this, one skilled in the art would reason that to remove the coke a significantly harder and more angular material, such as coarse sand or flint, would be required. Both of these were tried and found to be in general successful in removing the coke layer, however, since they were also harder than the tubing material, once the coke was removed, they began to abrade the tubing. This situation was found to be very severe in return bends where the particles impinged nearly directly on the tube wall. In several instances, return bends were completely abraded through before the coke deposits were removed from the walls of the straight tubing sections.

Although coke samples were highly resistant to abrasion, further testing using the Rockwell method indicated that the material had little resistance to impact, e.g. low toughness.

When the particle strikes the fluid boundary surface there is an energy exchange: the kinetic energy of the particle is converted to strain energy and several results are possible which depend on the strain energy capacity, commonly referred to as toughness, of both the particle and the object with which it collides.

Generally speaking, if the toughness of both the particle and the fluid boundary are equal, the kinetic energy will be converted to strain energy and shared nearly equally by both. If the collision is elastic, that is, if the kinetic energy of the particle is less than the sum of the strain energy capacity of both materials to the elastic limit, both materials will momentarily deform elastically then restore to initial shape and the kinetic energy of the particle will be conserved. Not unless the kinetic energy of the particle exceeds the sum total strain energy capacity of both materials will either the particle or the fluid boundary surface fracture.

It will be necessary to consider one other case: that where a particle with high toughness strikes a material with considerably lower toughness. In this case, if the kinetic energy of the particle is greater than twice the strain energy capacity of the fluid boundary surface, the surface will fracture and the particle will remain intact.

The method of the proposed invention is based on removing the coke deposits by impact. The preferred particles, contrary to what one would expect, are of impact resistant non-abrasive material and of non-angular configuration, an example of which is steel shot. The impact resistant character ensures maximum energy transfer to the coke formation while the non-abrasive, non-angular configuration prevents grinding type abrasion of tubing walls and gouging type abrasion of return bends. Particle diameter will vary with furnace geometry and coke thickness, but in general will range approximately between 0.01 and 0.1 inches in diamter. The particle is sized, based on inlet gas velocity which provides a limit on the maximum particle size than can be suspended.

The preferred propellant gas is of the inert species, the most common example of which is nitrogen. The inert character prevents high temperature reaction with the solid coke deposit. However, if the furnace is first cooled to a temperature below that required for reaction of coke and air, compressed air would suffice. Mass flow rates should be sufficient to provide exit velocities of 14,000 to 20,000 feet per minute. Testing indicates negligible gain in cleaning effectiveness when exit velocities are increased above 20,000 feet per minute.

In general, the rate of coke removal increases with increasing particle concentration, however, it has been found that the removal rate can get excessive; the high concentration of coke debris will create system back pressure which will in turn cause a drop in inlet velocity. The removal rate is maximized by increasing particle concentration to the point where the inlet velocity reaches a preselected minimum corresponding to the minimum particle transport velocity. Experience to date has been with particle concentrations of 0.1 to 1.0 pounds of particles per pound of propellant.

EXAMPLE

The following example of a typical embodiment of the invention is provided for illustrative purposes so that one skilled in the art may determine how to practice the invention.

Apparatus as shown in the drawing was connected to a radiant section of a fired heater. Nitrogen gas was used as the purge gas and injected through inlet 23 at about 1,000 scfm to remove loose debris. The purge stream was continued for about five (5) minutes and then shut off. Then a nitrogen propelling stream was turned on and steel shot (Society of Automotive Engineers size number 780) was simultaneously introduced into the propelling stream at a concentration of about 0.35 pounds per pound of nitrogen. The steel shot containing nitrogen stream was introduced into the inlet of the tubes through an injection head (12) to impart an initial swirling action to such stream at a gas flow rate corresponding to an outlet velocity of about 19,000 feet per minute. Such stream was continued until the steel shot contained in the supply pot (10) was exhausted. Then valve 6 was closed and the flow of nitrogen was continued through valve 16 to clear the tubes of any loose coke debris.

Approximately five (5) minutes after exhausting the steel shot, pressure readings were taken at $P_3$, $P_{13}$ and $P_{14}$. At the start, $P_3$ was 45–50 psig and $P_{13}$ was 40 psig; and $P_{14}$ was 230 psig. During the flow test taken five minutes after the steel shot was exhausted, $P_3$ was 19 psig and $P_{13}$ was 18 psig and $P_{14}$ was 230 psig. The decrease in pressure at $P_3$ indicates that the tubes were being cleaned.

The above procedure was repeated until no noticeable coke was discharged with the effluent and until the pressure $P_3$ remained constant.

Having described the invention with reference to certain embodiments thereof, it is understood that certain modifications can be made thereto without departing from the spirit and scope of this invention.

What is claimed is:

1. A method for decoking fired heater tubes of a serpentine configuration used in hydrocarbon processing while maintaining the integrity of the tube walls and return bends comprising (a) establishing a gas inlet to and a gas outlet from said fired heater tubes of a serpentine configuration;

(b) injecting a purge gas stream into the inlet while the outlet is open to atmosphere to purge the tubes of loose debris until the effluent is clear;

(c) entraining impact resistant, non-angular, non-abrasive particles into a propelling gas stream at a concentration of 0.1 to 1.0 pounds of particles per pound of propellant;

(d) introducing the impact resistant, non-angular, non-abrasive particle entrained gas stream into the inlet of said fired heater tubes of a serpentine configuration while the outlet remains open to the atmosphere at a gas flow rate corresponding to an outlet gas velocity of 14,000 to 20,000 feet per minute;

(e) maintaining the flow of the gas stream in step (d) until the inlet pressure to the tubes reaches a preselected maximum value;

(f) discontinuing entraining impact resistant, non-angular, non-abrasive particles into said propelling gas stream;

(g) continuing the flow of propelling gas into said tubes to clear such tubes of loose coke debris; and (h) repeating steps (c), (d), (e) and (f) until the tubes are clean, as evidenced by a coke-free clear effluent from the outlet whereby grinding-type abrasion of the tube walls and gouging-type abrasion of the return bends is eliminated.

2. Process of claim 1 wherein said process is carried out with the fired heater tubes between ambient temperature and process operating temperature.

3. Process of claims 1 or 2 wherein said propelling gas is nitrogen.

4. Process of claims 1 or 2 wherein said particles are steel shot.

5. Process according to claims 1 or 2 wherein following purge step (b) the purge gas flow is terminated and the tube set allowed to return to atmospheric pressure whereupon the impact resistant, non-angular, non-abrasive particle entrained gas stream is introduced into the inlet of said tubes.

* * * * *